United States Patent [19]

Tischler

[11] 4,017,922

[45] Apr. 19, 1977

[54] FURNITURE DECK CONSTRUCTION

[75] Inventor: Henry J. Tischler, Bloomfield Hills, Mich.

[73] Assignee: Gulf & Western Metals Forming Company, Southfield, Mich.

[22] Filed: Nov. 24, 1975

[21] Appl. No.: 634,414

[52] U.S. Cl. ..... 5/354

[51] Int. Cl.[2] ..... A47C 23/00

[58] Field of Search ..... 5/354

[56] References Cited

UNITED STATES PATENTS 3,317,935 5/1967 Berger ..... 5/354 X

*Primary Examiner*—James C. Mitchell

*Attorney, Agent, or Firm*—Barnes, Kisselle, Raisch & Choate

[57] ABSTRACT

A furniture construction comprising a frame, a plurality of sinuous wire elements fastened to the frame, and a pad over the wires and fastened to the frame. The pad has a plurality of transversely spaced longitudinally extending wires woven therein such that portions of the wires are exposed along one surface only of the pad.

13 Claims, 3 Drawing Figures

FURNITURE DECK CONSTRUCTION

This invention relates to furniture deck construction.

BACKGROUND OF THE INVENTION

In the manufacture of furniture, it is common to provide a deck for the cushions of the furniture by providing a very light sheeting of cloth over the sinuous wire elements which are fastened to the furniture frame and tacking or otherwise fastening the cloth to the frame. A wire pad support is then placed over the sheeting. The wire pad support, commonly known as an insulator pad, comprises a thick sheet of material such as burlap through which wires are threaded. In order to complete the deck, a soft pad is placed over the wire pad support. A cloth sheet is then placed over the wire pad support and the soft pad and fastened to the furniture frame.

It can thus be seen that the deck comprises the use of a sheeting of cloth, a wire pad support and a soft pad.

Among the objects of the invention are to provide a construction which eliminates some of the parts and produces a furniture construction which is lower in cost and more easily manufactured.

SUMMARY OF THE INVENTION

In accordance with the invention, the light sheeting of cloth, the wire pad support and the soft pad are replaced by a composite pad of resilient material having transversely extending longitudinally spaced wires woven therein, which wires have portions thereof exposed along one surface only of the pad. The furniture deck is completed by placing a layer of cloth over the pad and fastening the cloth and composite pad to the frame.

DESCRIPTION

Figure 1:
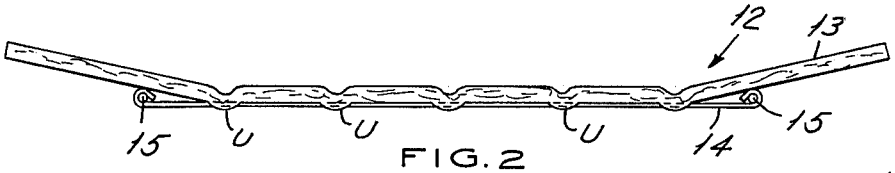
FIG. 1 is a side elevational view of a novel composite pad utilized in the invention.
Figure 2:
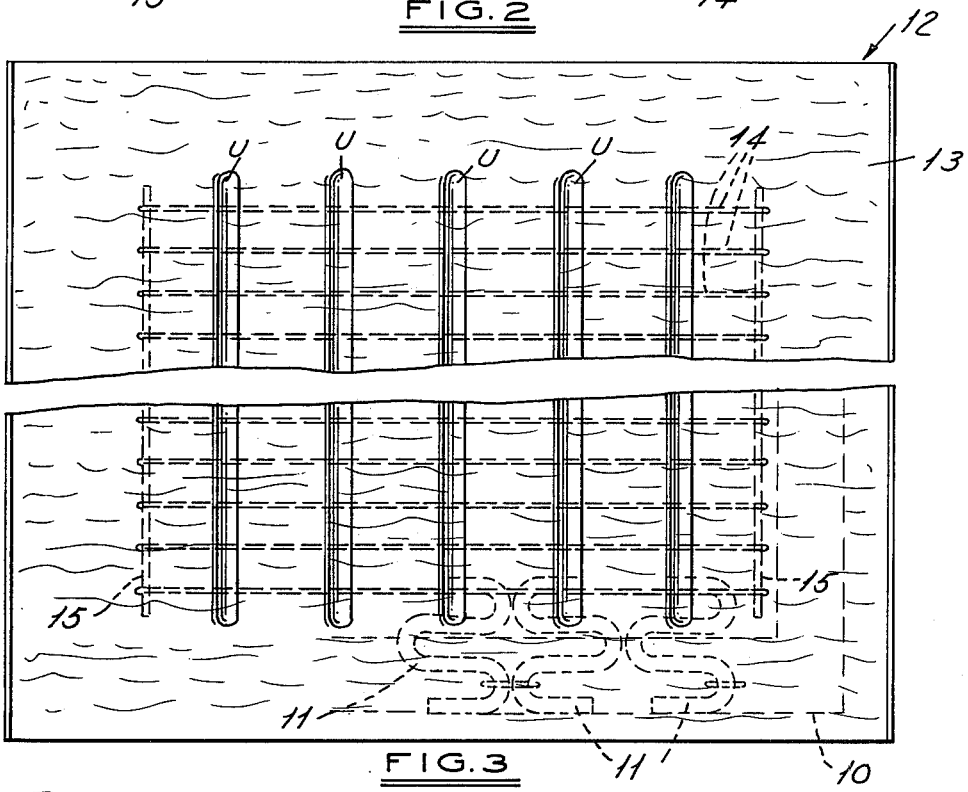
FIG. 2 is a plan view of the same.
Figure 3:
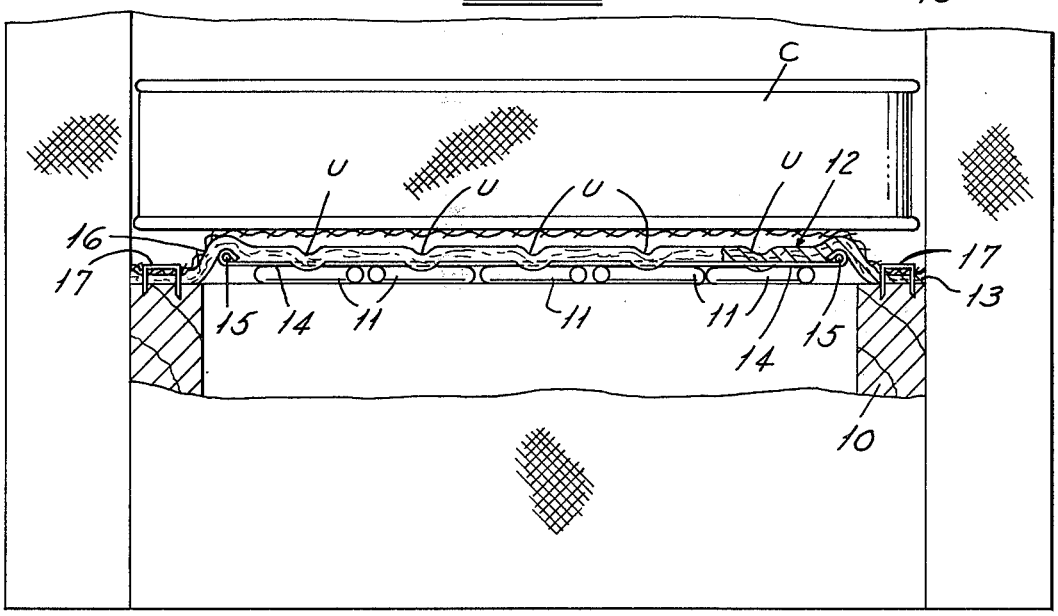
FIG. 3 is a part sectional elevational view of a piece of furniture, such as a chair, embodying the invention.

In accordance with the invention, the furniture construction for a piece of furniture, such as a chair, comprises a frame 10 of wood and the like which has front, rear, and side walls. A plurality of spaced parallel sinuous springs 11 have their ends fastened to the front and rear walls of the frame, in accordance with conventional construction.

A composite pad 12 in accordance with the invention is placed over the springs and a layer of cloth 16 is provided over the composite pad 12 to complete the deck for receiving a cushion C.

The composite pad 12 includes a pad of relatively thick, flexible, compressible material such as matted polyester fibers, resinated cotton, foam rubber or polyurethane.

The composite pad 12 further includes a plurality of transversely spaced longitudinally extending wires 14 threaded therethrough so that longitudinally spaced portions thereof are exposed along one surface only of the composite pad 12, namely, the surface which is adjacent the sinuous springs 11. The weaving of the wires 14 through the layer 13 causes undulations U of the layer 13. The wires 14 have their ends turned over transverse wires 15.

The composite pad 12 and cloth layer 16 are fastened to the frame by suitable fasteners such as staples.

It can thus be seen that there has been provided a furniture construction which produces a deck utilizing fewer parts and which can be more readily manufactured.

Although the invention has particular utility in furniture construction, the composite pad embodying the invention can also be utilized in bedding such as mattresses and box springs.

I claim:

1. In a furniture construction, the combination comprising a frame, a plurality of sinuous springs fastened to the frame, a composite pad overlying said springs, said pad comprising a layer of relatively thick, flexible, compressible material, and a plurality of transversely spaced longitudinally extendng wires woven therethrough with longitudinally spaced portions of the wires being exposed along one surface only of said layer, a sheet of flexible material over said pad, and means for fastening said sheet and said pad to said frame.

2. The combination set forth in claim 1 wherein said wires are straight.

3. The combination set forth in claim 1 wherein said wires are adjacent said sinuous springs.

4. The combination set forth in claim 1 wherein said layer comprises polyester fibers.

5. The combination set forth in claim 1 wherein said layer comprises resinated cotton.

6. The combination set forth in claim 1 wherein said layer comprises foam rubber.

7. The combination set forth in claim 1 wherein said layer comprises polyurethane.

8. A composite pad for furniture and the like comprising a relatively thick, flexible, compressible layer of material, and a plurality of transversely spaced longitudinally extending wires threaded through said material such that longitudinally spaced portions of said wires are exposed along one surface only of said layer.

9. The combination set forth in claim 8 wherein said wires are straight.

10. The combination set forth in claim 8 wherein said layer comprises polyester fibers.

11. The combination set forth in claim 8 wherein said layer comprises resinated cotton.

12. The combination set forth in claim 8 wherein said layer comprises foam rubber.

13. The combination set forth in claim 8 wherein said layer comprises polyurethane.

* * * * *